US009716339B2

(12) United States Patent
Burrow

(10) Patent No.: US 9,716,339 B2
(45) Date of Patent: Jul. 25, 2017

(54) UNDERWATER CONNECTOR PART

(71) Applicant: Siemens Aktiengesellschaft, München (DE)

(72) Inventor: Christopher Burrow, Ulverston (GB)

(73) Assignee: SIEMENS AKIENGESELLSCHAFT, Munich (DE)

( * ) Notice: Subject to any disclaimer, the term of this patent is extended or adjusted under 35 U.S.C. 154(b) by 0 days.

(21) Appl. No.: 14/900,629

(22) PCT Filed: Aug. 25, 2014

(86) PCT No.: PCT/EP2014/067966
§ 371 (c)(1),
(2) Date: Dec. 22, 2015

(87) PCT Pub. No.: WO2015/032640
PCT Pub. Date: Mar. 12, 2015

(65) Prior Publication Data

US 2016/0181724 A1 Jun. 23, 2016

(30) Foreign Application Priority Data

Sep. 6, 2013 (EP) ..... 13183375

(51) Int. Cl.
*H01R 13/52* (2006.01)
*H01R 13/523* (2006.01)

(52) U.S. Cl.
CPC ..... *H01R 13/523* (2013.01); *H01R 13/5202* (2013.01)

(58) Field of Classification Search
CPC ..... H01R 13/523
(Continued)

(56) References Cited

U.S. PATENT DOCUMENTS 5,645,442 A * 7/1997 Cairns ..... H01R 13/523 439/201
5,722,842 A * 3/1998 Cairns ..... G02B 6/3816 439/139

(Continued)

FOREIGN PATENT DOCUMENTS

GB 2364451 A 1/2002
GB 2429587 A 2/2007
WO WO-0140837 A2 6/2001

OTHER PUBLICATIONS

International Search Report PCT/ISA/210 for International Application No. PCT/EP2014/067966 dated Oct. 30, 2014.

(Continued)

*Primary Examiner* — Tulsidas C Patel
*Assistant Examiner* — Peter G Leigh
(74) *Attorney, Agent, or Firm* — Harness, Dickey & Pierce, P.L.C.

(57) ABSTRACT

A connector part for use underwater or in a wet or severe environment is provided. The connector part has a pin projecting axially forwardly from a support and a sliding carriage which is in sealing engagement with the pin. The sliding carriage is movable between an unmated position and a mated position along the pin. A diaphragm is furthermore provided which encloses a volume around the pin. The diaphragm has a first sealing portion that is sealed to the sliding carriage and a second sealing portion that is sealed to a portion of the connector part which is stationary relative to the pin.

27 Claims, 7 Drawing Sheets

(58) Field of Classification Search
USPC ..... 439/271, 311, 190, 191, 197, 199, 700; 385/53, 56, 60
See application file for complete search history.

(56) References Cited

U.S. PATENT DOCUMENTS

| | | | | |
|---|---|---|---|---|
| 5,738,535 | A * | 4/1998 | Cairns | G02B 6/3816 439/138 |
| 6,315,461 | B1 * | 11/2001 | Cairns | G02B 6/3816 385/139 |
| 6,332,787 | B1 * | 12/2001 | Barlow | H01R 13/5227 439/138 |
| 6,464,405 | B2 * | 10/2002 | Cairns | G02B 6/3816 385/139 |
| 6,561,268 | B2 * | 5/2003 | Jones | H01R 13/523 166/338 |
| 6,736,545 | B2 * | 5/2004 | Cairns | G02B 6/3816 174/74 R |
| 7,244,132 | B1 * | 7/2007 | Cairns | H01R 13/523 439/191 |
| 7,364,448 | B2 * | 4/2008 | Cairns | G02B 6/3816 439/201 |
| 7,530,744 | B2 * | 5/2009 | Prel | G02B 6/3816 385/111 |
| 7,695,301 | B2 * | 4/2010 | Mudge, III | H01R 13/533 439/271 |
| 7,845,966 | B2 * | 12/2010 | Rioufreyt | H01R 13/5213 439/137 |
| 8,192,089 | B2 * | 6/2012 | Cairns | G02B 6/3816 385/138 |
| 8,376,765 | B2 * | 2/2013 | Chaize | E21B 33/0385 439/201 |
| 9,157,561 | B2 * | 10/2015 | Martin | F16L 37/35 |
| 2002/0014336 | A1 | 2/2002 | Jones | |
| 2007/0045003 | A1 * | 3/2007 | Cairns | H01B 7/28 174/539 |
| 2014/0073176 | A1 * | 3/2014 | Plant | H01R 13/523 439/519 |
| 2015/0207265 | A1 * | 7/2015 | Plant | H01R 13/523 439/271 |

OTHER PUBLICATIONS

Written Opinion of the International Searching Authority PCT/ISA/237 for International Application No. PCT/EP2014/067966 dated Oct. 30, 2014.

"Toughened Thermosets strengthen Undersea Connectors"; Machine Design; Penton Media, Cleveland,OH, US; vol. 62; No. 17; pp. 42; ISSN: 0024-9114; XP000159129;; 1990.

Extended European Search Report dated Feb. 20, 2014.

International Search Report and Written Opinion dated Nov. 12, 2014.

* cited by examiner

UNDERWATER CONNECTOR PART

PRIORITY STATEMENT

This application is the national phase under 35 U.S.C. §371 of PCT International Application No. PCT/EP2014/067966 which has an International filing date of Aug. 25, 2014, which designated the United States of America and which claims priority to European patent application number EP13183375.8 filed Sep. 6, 2013, the entire contents of which are hereby incorporated herein by reference.

FIELD

An embodiment of the invention generally relates to a connector part for use underwater or in a wet or severe environment. An embodiment of the invention generally relates to a diaphragm for such convector part, and to a subsea connector.

BACKGROUND

Several applications are known in which electrical connections need to be provided underwater. Examples include a subsea installation for the production of hydrocarbons from a subsea well, in which different components of the subsea installation need to be connected electrically. Such connections may for example comprise a connection from a topside installation, such as a floating or fixed platform, or from an onshore site to a subsea component. Such connection can be provided by an umbilical or a subsea cable. Other connections include electrical connections between different types of subsea equipment, such as a connection between a subsea transformer and subsea switchgear, electrical connections to a pump or a compressor or the like.

For providing an underwater electrical connection, wet-mateable connectors are known which can be mated underwater. Although such type of connector is generally more complex than a corresponding dry-mate connector, which has to be mated above water, wet-mateable connectors have several advantages. Components of the subsea installation can for example be disconnected under water and can be retrieved for servicing or exchange, additional components may be connected to an existing subsea installation, a subsea installation can be connected electrically after installation thereof at the ocean floor, and the like.

A general problem with subsea connectors is the corrosive character of seawater. Seawater generally causes corrosion and degradation of materials exposed thereto. Exposed surfaces are furthermore prone to the growth of organic material thereon, such as algae, bacteria and the like. Such marine growth can be detrimental to the functioning of the subsea connector.

From the document GB 2 429 587 A, an electrical connector for underwater mating is known which has an isolation tube containing dielectric oil. A rear lip-seal seals onto the isolation tube. When the contactor is mated, the rear lip-seal moves along the surface of the isolation tube. Since the isolation tube is exposed to seawater, so that marine growth can occur, the sliding seal is vulnerable to wear and tear, and there may be the danger of a leakage after a certain number of mating/de-mating cycles.

Another possibility of protecting a part of a subsea connector is the providing of a so called "dummy plug" to which the connector part is mated when it is not in use, i.e. when it is unplugged. Components of the connector part, such as a pin can thus be protected effectively from the surrounding seawater. Such dummy plug generally needs to include all features of a standard plug at its connecting section, but does not connect to a cable but only to a dummy gland, which isolates the pin from the metal work and which may be used for electrical testing. As such dummy plug may need to be provided for each un-mated connector part, significant costs can be incurred.

SUMMARY

The inventors have discovered that it is desirable to protect components of a connector part in a reliable and effective way. In particular, the complexity of the connector part should not be increased significantly. Also, the inventors have discovered that it is desirable that the connector part remains operational over a relatively large number of mating/demating cycles. Furthermore, the inventors have discovered that it is desirable to provide protection of the connector components in a cost-efficient way.

Accordingly, the inventors have discovered that there is a need for improving the protection, for a component, in particular a pin, of a connector part, and to obviate at least some of the drawbacks mentioned above.

The claims describe embodiments of the invention.

According to an embodiment of the invention, a connector part for use underwater or in a wet or severe environment is provided. The connector part comprises a pin projecting axially forwardly from a support and a sliding carriage which is in sealing engagement with the pin. The sliding carriage is movable between an unmated position and a mated position along the pin. The sliding carriage is in sealing engagement with the pin both in the unmated and in the mated position. The connector part further comprises a diaphragm enclosing a volume around the pin. The diaphragm has a first sealing portion that is mounted to and sealed to the sliding carriage so that it is movable together with the sliding carriage. The diaphragm further has a second sealing portion that is sealed to a portion of the connector part which is stationary relative to the pin and the support and arranged, in the unmated position, backwardly of the sliding carriage.

According to a further embodiment of the invention, a diaphragm for use with a connector part in any of the above described configurations is provided. The diaphragm comprises a first end surrounding a first opening, the first end providing the first sealing portion of the diaphragm. The diaphragm is molded such that the first end is folded inwards so that the first end is located within a volume surrounded by the diaphragm. The diaphragm further comprises a second end surrounding a second opening, the second sealing portion being located at or adjacent to the second end, and a diaphragm body extending between the first end and the second. In an embodiment, the diaphragm may further comprise a latching portion which is adjacent to or forms part of the second sealing portion. The latching portion may comprise a step in the outer diaphragm surface for engagement with a complementary latching portion of the connector part. Such type of diaphragm may allow an effective protection of the pin against ambient medium while at the same time, may lead to a relatively compact assembly of relatively low complexity. Furthermore, such type of diaphragm may facilitate the assembly of the connector part.

According to a further embodiment of the invention, a subsea connector is provided which comprises a first connector part configured in accordance with any of the above outlined embodiments. The subsea connector further comprises a second connector part which is wet-mateable with the first connector part. The first and second connector parts are configured such that during mating, the sliding carriage is moved from the unmated position into the mated position. With such subsea connector, advantages similar to the ones outlined further above may be achieved.

According to another embodiment of the invention, a method of assembling a connector part for use underwater or in a wet or severe environment is provided. The method comprises the steps of providing a connector part comprising a pin and a sliding carriage which is in sealing engagement with the pin and which is movable along the pin between an unmated position and a mated position. The sliding carriage is in sealing engagement with the pin both in the unmated and in the mated position. The method further comprises providing a hollow diaphragm having a first opening and a second opening; mounting the diaphragm at the first opening (34) to the sliding carriage; sealing the first opening of the diaphragm at a first sealing portion against the sliding carriage so that the first sealing portion (31) is movable together with the sliding carriage; and sealing the second opening of the diaphragm at a second sealing portion against a portion of the connector part which is stationary relative to the pin and the support. The sealing is such that the diaphragm encloses a volume around the pin. By such method, a connector part may be assembled which has advantages similar to the ones outlined further above.

It is to be understood that the features mentioned above and those yet to be explained below can be used not only in the respective combinations indicated, but also in other combinations or in isolation, without leaving the scope of the present invention. In particular, the connector part according to embodiments of the invention may comprise features as described with respect to embodiments of the method of the invention, and embodiments of the method may comprise steps for assembling a connector part which is configured in accordance with any of the described embodiments.

BRIEF DESCRIPTION OF THE DRAWINGS

The foregoing and other features and advantages of the invention will become further apparent from the following detailed description read in conjunction with the accompanying drawings. In the drawings, like reference numerals refer to like elements.

DETAILED DESCRIPTION OF EXAMPLE EMBODIMENTS

Figure 1:
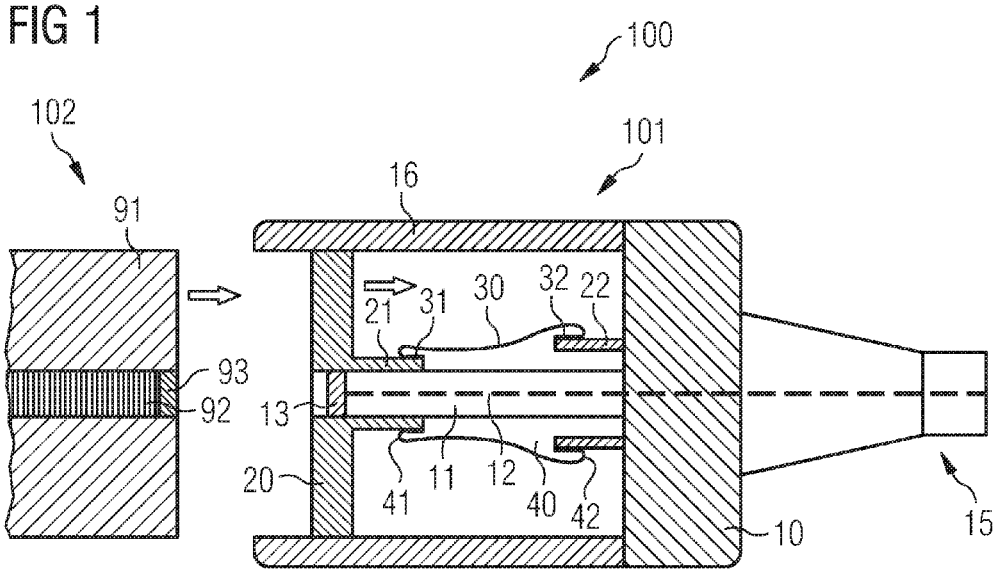
FIG. 1 is a schematic drawing showing a sectional side view of a connector part according to an embodiment of the invention in an unmated position.

According to an embodiment of the invention, a connector part for use underwater or in a wet or severe environment is provided. The connector part comprises a pin projecting axially forwardly from a support and a sliding carriage which is in sealing engagement with the pin. The sliding carriage is movable between an unmated position and a mated position along the pin. The sliding carriage is in sealing engagement with the pin both in the unmated and in the mated position. The connector part further comprises a diaphragm enclosing a volume around the pin. The diaphragm has a first sealing portion that is mounted to and sealed to the sliding carriage so that it is movable together with the sliding carriage. The diaphragm further has a second sealing portion that is sealed to a portion of the connector part which is stationary relative to the pin and the support and arranged, in the unmated position, backwardly of the sliding carriage.

Accordingly, with the second sealing portion of the diaphragm being sealed to a stationary portion of the connector part, the second sealing portion of the diaphragm does not need to move over a surface which is exposed to seawater, and which thus may be deteriorated or may suffer from marine growth. Sealing is thus improved and the connector part may remain operable over a higher number of mating/demating cycles. The portion of the connector part to which the second sealing portion of the diaphragm is sealed may be termed 'seal seat', without limiting the structural implementation thereof, i.e. the seal seat may simply be a plane or recessed surface or any other portion of the connector part. A seal seat which is stationary relative to the pin may for example be provided on part of the pin, on part of the support, on a sleeve projecting from the support or the like. That the seal seat is arranged backwardly of the sliding carriage at least in the unmated position means that it is arranged in direction of the support, i.e. between the sliding carriage in the unmated position and the support.

The connector part may be wet-mateable with a second connector part, the connector part may for example be a receptacle part which is mateable with a plug part. The unmated position of the sliding carriage may thus correspond to a situation in which the connector part is unmated, whereas the mated position of the sliding carriage may correspond to a situation in which the connector part is mated to the second connector part.

According to an embodiment, the diaphragm is configured such that when the sliding carriage moves from the unmated position to the mated position, the first sealing portion of the diaphragm moves relative to the pin towards the second sealing portion of the diaphragm, the second sealing portion remaining stationary relative to the pin. By moving the sliding carriage with the first sealing portion in such way, the sealing between the sliding carriage and the pin can be a clean seal, meaning that it slides on a surface which is protected from the surrounding medium, e.g. seawater, by the diaphragm. The lifetime of the connector part may thus be improved and leakage or failure of the seal may be prevented.

In the unmated position, the diaphragm may extend axially along at least a portion of the pin, thereby protecting the portion of the pin from the ambient medium.

In an embodiment, the diaphragm provides a liquid tight barrier around the pin such that in the unmated position of the sliding carriage, the circumferential face of the pin between the support and the sliding carriage is protected from ambient medium. Accordingly, the whole circumferential face of the pin may be protected in the unmated position, whereby a dummy plug may no longer be required for protecting the connector part when it is unmated.

In an embodiment, the pin has an axial length, and the portion of the connector part (seal seat) to which the second sealing portion of the diaphragm is sealed may be located at an axial position within the rear third of the pin's axial length, preferably within the rear quarter of the pin's axial length. "rear" refers to the backward portion of the pin, i.e. to the pin portion adjacent to the support. In such configuration, a relatively large fraction of the pin may be exposed when the sliding carriage is in the unmated position, and may thus be available for interaction with the second connector part, e.g. the plug part.

In an embodiment, the connector part may comprise a first sleeve extending backwardly from the sliding carriage, and the first sealing portion of the diaphragm may be arranged on a backward end of the first sleeve. The connector part may further comprise a second sleeve extending forwardly from the support, the second sealing portion of the diaphragm being arranged at a forward end of the second sleeve. The first sleeve and the second sleeve may be configured so as to at least partially slide over each other when the sliding carriage is moved into the mated position. Such configuration may allow the sliding carriage to move a relatively large distance towards the support so as to expose a relatively large fraction of the pin's length. Accordingly, the pin can be kept relatively short for enabling a certain demate/mate stroke length which may be required when mating first and second connector parts.

The first and/or second sleeve may have a length of less than one third of the length of the pin. Furthermore, the sleeves and the diaphragm may be configured such that in the unmated position of the sliding carriage, a portion of the diaphragm may be located directly adjacent to the respective sleeve over the majority (i.e. more than 50%, 60% or even 70%) of the length of the respective sleeve. The sliding carriage may thus be moved relatively close to the support when in the mated position, thus keeping the required length of the pin relatively short. In the unmated position of the sliding carriage, the diaphragm may be folded away from the respective sleeve. A relatively large travelling distance of the sliding carriage may thus be achieved.

As an example, in the unmated position, a front face of the sliding carriage may be positioned forwardly of a connection portion of the pin, which may be provided for establishing an electrical connection. The front face of the sliding carriage may for example be positioned such that the circumferential face of the pin at the front of the pin is covered by the sliding carriage, so that in the unmated position, the connection portion of the pin is not exposed to ambient medium. The diaphragm may furthermore be arranged such that none of the circumferential surface of the pin between the connection portion of the pin and the support is exposed to the ambient medium in the unmated position.

In an embodiment, the pin projects axially forwardly from the support by a predefined axial length. The diaphragm may be configured so as to enable a movement of the sliding carriage to a mated position in which more than 50% of the axial length of the pin are exposed. Preferably, at least 60% of the axial length of the pin are exposed, more preferably at least 70% of the axial length of the pin are exposed. By enabling such relatively large travel distance of the sliding carriage, the pin length that is required for achieving a demate/mate stroke of a certain distance can be reduced. A shorter pin length is generally desirable for reasons of reducing electrical and mechanical stresses in the pin. In such configuration, the length of the pin may be reduced to below 1.4 or even 1.3 times of the demate/mate stroke length required by the connector part. Exposed in the above sense means that the pin is projecting forwardly from the sliding carriage. It does not mean that the pin is exposed to ambient medium, as the pin will generally be comprised within the second connector part and thus be protected from ambient medium when the plug part is mated and thus the sliding carriage is in the mated position.

Accordingly, with such configuration, a demate/mate stroke length of more than 50% of the pin length, preferably at least 60% or even at least 70% of the pin length can be achieved. Other mechanisms which may for example use a telescopic approach are generally limited to a stroke length of less than 50% of the pin length.

In an embodiment, in the mated position of the sliding carriage, the diaphragm forms at least a first fold, so that at least a first axial portion and a second axial portion of the diaphragm overlap in radial direction. Axial portion in this sense means that it is a portion which extends along the pin axis (longitudinal extension of the pin). The overlap is generally in radial direction, meaning that when moving from the pin surface outward in a radial direction, at least two layers of diaphragm are crossed. As an example, in the mated position of the sliding carriage, a front portion and a rear portion of the diaphragm may overlap.

In a further embodiment, at least a first and a second fold are formed so that at least a forward (axial) portion, a middle (axial) portion and a rearward (axial) portion of the diaphragm overlap when the sliding carriage is in the mated position. A compact configuration of the diaphragm in the mated position can thus be achieved, thereby enabling a relatively large travel distance of the sliding carriage, thus improving the stroke length relative to a pin length of the connector part.

Furthermore, the diaphragm may be configured such that the volume enclosed by the diaphragm in the unmated position of the sliding carriage is substantially the same as the volume enclosed by the diaphragm in the mated position of the sliding carriage. By enabling a folding of the diaphragm as described above, relatively large shaped deformations of the diaphragm become possible while the volume enclosed by the diaphragm remains relatively constant.

In an embodiment, the sliding carriage and the diaphragm are configured such that in the unmated position of the sliding carriage, the first sealing portion is located forwardly of the second sealing portion of the diaphragm, and that in the mated position of the sliding carriage, the first sealing portion is located backwardly of the second sealing portion of the diaphragm. By enabling such change in position of the sealing portions, the diaphragm may be folded to a relatively compact size, whereby the traveling distance of the sliding carriage may be improved. This may for example by achieved by way of the sleeves as outlined above. Forwardly again means away from the support in the direction of the tip of the pin, i.e. closer to the tip of the pin. Backwardly means in direction of the support, i.e. closer to the support.

In an embodiment, the diaphragm has a first opening, the first sealing portion being located at a first end of the diaphragm surrounding the first opening. The first end of the diaphragm may be folded inwards and a part of the sliding carriage may be arranged within the first opening. The folding may be such that a first end of the diaphragm is pointing towards the support. By providing such fold, a rolling motion of the diaphragm is enabling an effective expansion and compression of the axial length of the diaphragm.

The sliding carriage may for example comprise a first sleeve (or carriage sleeve) which extends from the sliding carriage axially along the pin towards the support. The first sealing portion of the diaphragm may be arranged at and sealed against the end of the first sleeve which is pointing towards the support.

In the unmated position of the sliding carriage, the fold may be located in proximity to this end of the first sleeve, and in the mated position of the sliding carriage, the fold may be located further away from the end of the first sleeve so that the diaphragm extends along a portion of the first sleeve, e.g. over at least 60% or 70% of the axial length of the first sleeve.

A locking ring may furthermore be provided and be disposed around the first end of the diaphragm such that the first sealing portion is held and sealed against the sliding carriage (in particular against the carriage sleeve).

In an embodiment, the connector part further comprises a sleeve extending axially forwardly from the support. The sleeve which extends forwardly from the support will hereinafter be termed "second sleeve". The second sealing portion of the diaphragm may be in sealing engagement with this (second) sleeve. In particular, the seal seat, i.e. the portion of the connector part to which the second sealing portion of the diaphragm is sealed, may be located at a forward end portion of this second sleeve.

The second sleeve may surround a portion of the pin so as to form an annular space that is sized such that the first sealing portion of the diaphragm is movable into the annular space. Accordingly, when the sliding carriage is moved into the mated position, the first sealing portion of the diaphragm may be located inside this annular space, it may in particular be located closer to the support than the second sealing portion of the diaphragm. Accordingly, a compact configuration in the mated position may be achieved.

The diaphragm may have a second opening, and a second end of the diaphragm may surround the second opening. The second end of the diaphragm may be mounted to the second sleeve such that the second end of the diaphragm points towards the support. The second end of the diaphragm may again be fixed to the second sleeve by way of a locking ring.

In an embodiment, the diaphragm may have a portion that extends from the second sealing portion towards the support, a fold adjacent to the portion, and a further portion adjacent to the fold which extends away from the support, such that the fold is moving towards the support when the sliding carriage is moved from the unmated position to the mated position. Accordingly, a rolling motion of the diaphragm may also be achieved at the end of the diaphragm which is sealed against the stationary seal seat. Instead of using a sliding seal, the diaphragm may thus simply lay over portions of the connector which may be prone to marine growth, thereby reducing the danger of leakage.

Accordingly, in some embodiments, both sides of the diaphragm may perform a rolling motion when the sliding carriage is moved from the unmated position into the mated position. An effective and reliable protection of the pin may thus be achieved, and the diaphragm can be folded into a compact configuration in the mated position of the sliding carriage.

In an embodiment, the diaphragm comprises an end portion at an end of the diaphragm (e.g. the second end) surrounding an opening of the diaphragm, the second sealing portion being comprised in the end portion. The end portion further comprises a fixation portion at which the diaphragm is fixed to the seal seat by way of a locking member (e.g. a locking ring), such that the end of the diaphragm points towards the support. The end portion further comprises a latching portion. The latching portion of the diaphragm is folded back over the fixation portion and the locking member. The latching portion of the diaphragm is latched, e.g. with the locking ring, so as to retain the folded back position of the diaphragm. In some embodiments, the latching portion may be latched to the locking member. In other embodiments, it may be latched against for example a portion of the second sleeve extending forwardly from the support.

The second sealing portion of the diaphragm may thus comprise a portion that is sealed against the second sleeve and held in place by the locking member, and additionally or alternatively a portion of the diaphragm that is folded over the locking member and sealed against the second sleeve and/or the locking member. The folding over of the diaphragm in such way may enable a relatively simple assembly of the connector part while at the same time, it may enable the rolling motion of the diaphragm towards the support. As an example, mounting of the diaphragm may be facilitated since the second end of the diaphragm may be moved onto the second sleeve and the locking member may subsequently be put into place. The diaphragm can then be folded over the locking member, thereby providing the above outlined configuration which has a fold in proximity to the support when in the mated position.

In an embodiment, the diaphragm may have a cross section with a non-circular profile, in particular with a corrugated profile. The non-circular profile may allow the volume enclosed by the diaphragm to change without substantially changing the length of the non-circular profile. Accordingly, to maintain the volume enclosed by the diaphragm when the sliding carriage is moved from the unmated position to the mated position, the diaphragm may deform for accommodating volume changes, without requiring a significant stretching of the diaphragm. Due to the folding of the diaphragm, the required volume changes which need to be accommodated by a change in the outer shape of the diaphragm are relatively low, so that the non-circular profile of the diaphragm can already account for these changes. Further changes may result from a change of the volume of the medium filling the volume enclosed by the diaphragm due to temperature, pressure or the like. Also, such configuration does not require an external device for volume compensation. The non-circular cross section may for example be provided by corrugations/convolutions in a central section of the diaphragm. When the diaphragm is fully compressed, the convolutions in the central section of the diaphragm may expand to form a more circular shape, thus increasing the volume of the central section. This volume increase may allow the ends of the diaphragm to be compressed and folded within each other. When the diaphragm is fully extended, i.e. in the unmated position, the convolutions in the central section may collapse and the volume may decrease. This may account for the additional volume that is generated by the extension of the previously folded sections of the diaphragm.

The diaphragm may for example have a corrugated surface in circumferential direction with at least three, preferably 4 to 20 corrugations in circumferential direction.

The volume enclosed by the diaphragm may be filled with a liquid, in particular with a dielectric liquid such as an oil, for example a synthetic Esther oil.

The connector part may be configured to be operable at a voltage of at least 3,000 V, preferably at least 10,000 V. In some configurations it may be operable at least 30,000 V or even at least 50,000 V. Such type on connector may particularly benefit from the reduction in the required pin length due to the reduction of electrical stresses. Furthermore, by the protection of the circumferential surface of the pin, it may be achieved that the insulation of the pin may remain operational over prolonged periods of time. Degradation of the pins electrical insulation, which is particularly critical in high voltage connectors, may thus be prevented.

The diaphragm may be made of an elastomeric material. It may for example me made of a rubber, e.g. silicone rubber, of a elastomeric polymer material or the like. In particular, the diaphragm may be made of a material having ozone and/or UV resistance. The material is preferably chosen to compatible with a medium filling the diaphragm, such as dielectric liquid, in particular dielectric oil. The material of the diaphragm may furthermore be configured so as to provide resistance against marine growth. The material of the diaphragm is preferably such that the physical properties do not significantly change over an extended period of time, e.g. over more than 5, 10 or even 20 years.

The diaphragm may, in the mated position, have a diameter between about 100 mm and about 200 mm, it may for example have a diameter of about 160 mm. The diaphragm further may, in the mated position (i.e. when folded or rolled up), have a (axial) length between about 50 mm and about 150 mm, it may for example have a length of about 100 mm. In the unmated position, the diaphragm may have a length of between about 200 mm and about 350 mm, it may for example have a length of about 280 mm. The diameter of the pin may be larger than 30 mm, or larger than 50 mm, it may for example be between about 30 and about 100 mm, e.g. 60 mm.

The pin and the sliding carriage may be configured such that in the unmated position of the sliding carriage, a front portion of the pin is exposed to the surrounding environment. The sliding carriage may thus have a relatively simple structure and is easy to manufacture.

Forwardly of the support, the pin may have a cylindrical portion which ends in an end face (in particular a circular end face) that faces away from the support. The sliding carriage may be disc-shaped and may be, in its unmated position, arranged around the cylindrical portion of the pin, in particular around a front portion thereof. The sliding carriage may be sealed against an outer cylindrical face of the cylindrical portion. At least the end face of the pin may be exposed to the surrounding environment in the unmated position of the sliding carriage. In such configuration, the sliding carriage does not need to have a device for avoiding the exposure of the end face to the surrounding environment (e.g. seawater when the connector is unmated and installed subsea), so that the sliding carriage can have a low complexity and manufacturing thereof is facilitated.

According to a further embodiment of the invention, a diaphragm for use with a connector part in any of the above described configurations is provided. The diaphragm comprises a first end surrounding a first opening, the first end providing the first sealing portion of the diaphragm. The diaphragm is molded such that the first end is folded inwards so that the first end is located within a volume surrounded by the diaphragm. The diaphragm further comprises a second end surrounding a second opening, the second sealing portion being located at or adjacent to the second end, and a diaphragm body extending between the first end and the second. In an embodiment, the diaphragm may further comprise a latching portion which is adjacent to or forms part of the second sealing portion. The latching portion may comprise a step in the outer diaphragm surface for engagement with a complementary latching portion of the connector part. Such type of diaphragm may allow an effective protection of the pin against ambient medium while at the same time, may lead to a relatively compact assembly of relatively low complexity. Furthermore, such type of diaphragm may facilitate the assembly of the connector part.

By folding over the diaphragm and by providing such latching portion on a diaphragm, it is possible to protect a locking member used to fix the end of the diaphragm to the sleeve extending forwardly from the support against ambient medium. Accordingly, a locking member, for example a locking ring, fixing the diaphragm to the second sleeve extending from the support may be protected from ambient medium.

The latching portion of the connector part may for example comprise a complementary step, it may for example be an edge of a locking member, such as a locking ring, for mounting the second opening of the diaphragm to the connector part.

The diaphragm may comprise a first protrusion at the first end and/or a second protrusion at the second end thereof. Mounting of the diaphragm to e.g. the first sleeve or the second sleeve of the connector part may thus be facilitated.

The diaphragm may furthermore comprise a port for filling a volume enclosed by the diaphragm with a liquid, in particular with dielectric liquid. In other configurations, the port for filling the volume enclosed by the diaphragm may be provided in another element of the connector part.

According to a further embodiment of the invention, a subsea connector is provided which comprises a first connector part configured in accordance with any of the above outlined embodiments. The subsea connector further comprises a second connector part which is wet-mateable with the first connector part. The first and second connector parts are configured such that during mating, the sliding carriage is moved from the unmated position into the mated position. With such subsea connector, advantages similar to the ones outlined further above may be achieved.

In an embodiment, the first connector part may be a receptacle part of the subsea connector and the second connector part may be a plug part of the subsea connector. The plug part may comprise at least one shuttle pin. The first and second connector parts may be configured such that during mating, the pin of the first connector part engages the shuttle pin, and a front surface of the plug engages the sliding carriage. The plug and the sliding carriage may move together from the unmated position to the mated position so that in the mated position, the part of the pin extending axially forwardly from the sliding carriage is comprised within the plug. In such configuration, it can be ensured the circumferential surface of the pin is neither in the unmated position nor in the mated position exposed to an ambient medium, such as seawater. Accordingly, integrity of the pin, the pin insulation and the seals can be ensured over an extended range of mating/demating cycles. Furthermore, the lifetime of the subsea connector, in particular of the pin insulation, can be increased.

According to another embodiment of the invention, a method of assembling a connector part for use underwater or in a wet or severe environment is provided. The method comprises the steps of providing a connector part comprising a pin and a sliding carriage which is in sealing engagement with the pin and which is movable along the pin between an unmated position and a mated position. The sliding carriage is in sealing engagement with the pin both in the unmated and in the mated position. The method further comprises providing a hollow diaphragm having a first opening and a second opening; mounting the diaphragm at the first opening (34) to the sliding carriage; sealing the first opening of the diaphragm at a first sealing portion against the sliding carriage so that the first sealing portion (31) is movable together with the sliding carriage; and sealing the second opening of the diaphragm at a second sealing portion against a portion of the connector part which is stationary relative to the pin and the support. The sealing is such that the diaphragm encloses a volume around the pin. By such method, a connector part may be assembled which has advantages similar to the ones outlined further above.

In embodiments of the method, the method may comprise further steps so as to assemble a connector part having any of the above outlined configurations.

The step of sealing the first opening of the diaphragm at the first sealing portion against the sliding carriage may for example comprise sliding the first opening of the diaphragm onto a sleeve extending from the sliding carriage and mounting a locking ring over an end of the diaphragm at the first opening, so as to fix the diaphragm at the first opening to the sleeve extending from the sliding carriage. The locking ring may be mounted such that the locking ring is located within the volume enclosed by the diaphragm after the connector part is assembled.

The step of sealing the second opening of the diaphragm at the second sealing portion against a portion of the connector part which is stationary relative to the pin (seal seat) may for example comprise sliding the second opening of the diaphragm over a sleeve extending from a support parallel to a portion of a pin, mounting a locking ring to a second end of the diaphragm at the second opening so as to fix the diaphragm at the second opening to the sleeve extending from the support, the locking ring being located outside the volume enclosed by the diaphragm, and folding the diaphragm over the locking ring such that the locking ring is sealed against an ambient medium. As an example, the diaphragm may comprise a latching portion, and the latching portion may be folded over the locking ring and latched against the locking ring or against the sleeve, so that the diaphragm remains in place after it is folded over the locking ring. By way of such method, mounting of the diaphragm can be facilitated, and both locking rings can be protected against ambient medium.

In the following, embodiments of the invention will be described in detail with reference to the accompanying drawings. It is to be understood that the following description of the embodiments is given only for the purpose of illustration and is not to be taken in a limiting sense. The drawings are to be regarded as being schematic representations only, and elements in the drawings are not necessarily to scale with each other. Rather, the representation of the various elements is chosen such that their function in general purpose become apparent to a person skilled in the art.

FIG. 1 is a schematic drawing of a subsea connector 100 having a first connector part 101 and a second connector part 102 according to an embodiment of the invention. In the description given hereinafter, the first connector part 101 is assumed to be a receptacle part of the subsea connector 100, and the second connector part 102 is considered to be a plug part. Other implementations are conceivable. The receptacle part 101 terminates a cable 15, such as a subsea cable or a jumper cable or the like. The receptacle part 101 has a support 10 from which a receptacle pin 11 extends forwardly, i.e. the pin 11 extends away from the support 10. The pin 11 comprises an electrical conductor 12 which is electrically connected to a conductor of the cable 15, as schematically illustrated by the dashed line in FIG. 1. The pin 11 further comprises an insulation surrounding the conductor 12.

In order to provide an electrical connection via the pin 11, a connection portion 13 is provided at a front portion, i.e. in proximity to the tip of the pin 11. This connection portion 13 may for example be a metal ring electrically connected to the electrical conductor 12. When mated with the plug part 102 of the subsea connector 100, an electrical connection is established between the connection portion 13 and a complementary connection member (not shown) of the plug part 102. Devices for establishing such electrical connection in a subsea connector 100 are known to the skilled person and will not be elaborated in more detail here.

The plug part 102 of the subsea connector 100 comprises the plug 91 in which a shuttle pin 92 having a front section 93 is provided.

FIG. 1 shows an unmated position in which the first connector part 101 is unmated from the second connector part 102. During mating, the plug 91 enters the receptacle of the connector part 101, thereby engaging the receptacle pin 11 with the shuttle pin 92. When the plug 91 is pushed into the receptacle of connector part 101, the shuttle pin 92 is pushed back inside the plug 91 so that the receptacle pin 11 enters the plug 91. In the mated position illustrated in FIG. 2, the receptacle pin 11 is positioned within the plug 91, and an electrical connection is established via the connection portion 13. Accordingly, a portion of the receptacle pin 11 and the connection portion 13 are protected from ambient medium when the first and second connector parts 101, 102 are in the mated position.

In conventional connectors, the receptacle pin 11 can be exposed to ambient medium, such as seawater, when the receptacle part 101 is not mated. To prevent corrosion and degradation of the pin 11, such conventional connector part was in the state of the art mated with a dummy plug, thereby protecting part of the pin 11 from the ambient medium. As mentioned above, such dummy plug needs to have almost the same functionality as a fully functional plug part of the subsea connector, in particular it requires a shuttle pin mechanism. Accordingly, such dummy plugs are relatively cost intensive to produce and in particular when a plurality of electrical connections need to be established, the additional expenses can be significant.

In the embodiment of FIG. 1, protection of the pin from surrounding seawater is achieved differently. A sliding carriage 20 is provided which is in sealing engagement with the pin 11, a seal may for example be provided which seals an inner surface of the sliding carriage 20 to the outer circumferential surface of the pin 11. The sliding carriage is movable along the pin, as indicated by the arrow in FIG. 1. In particular, the sliding carriage 20 is movable from an unmated position illustrated in FIG. 1 to a mated position illustrated in FIG. 2. In the unmated position of FIG. 1, the sliding carriage is located axially in proximity to a front portion of the pin 11, and in the mated position illustrated in FIG. 2, the sliding carriage 20 is located at a back portion of the pin 11. Front portion means a portion close to the tip of the pin 11, whereas rear or back portion means a portion close to the support 10. Forwards and forwardly mean towards the tip of the pin 11, whereas backwards and backwardly mean towards the support 10.

A diaphragm 30 is provided which encloses a volume 40 around the pin 11. The diaphragm 30 is at one end sealed against the sliding carriage 20, and at the other end sealed against a portion (seal seat) of the connector part 101 which is stationary with respect to the pin 11. Accordingly, when the sliding carriage 20 moves from the unmated position of FIG. 1 to the mated position of FIG. 2, and the plug 91 enters the receptacle, the first sealing portion 31 of the diaphragm 30 which is sealed against the sliding carriage 20 moves together with the sliding carriage, whereas a second sealing portion 32 of the diaphragm 30 which is sealed against the stationary portion of the connector part 101 remains stationary. Consequently, the diaphragm 30 changes its shape during the mating procedure.

The volume 40 enclosed by the diaphragm 30 can be filled with a medium, in particular a liquid such as a dielectric liquid. Examples are oil, such as synthetic Esther oil. Consequently, the outer circumferential surface of pin 11 is protected from the ambient medium, in particular from seawater, even when the connector part 101 is unmated, and the sliding carriage 20 is in the unmated position. The seal provided in the sliding carriage 20 only slides on the outer circumferential surface of pin 11 which is protected by the diaphragm 30 and the filling medium from ambient seawater. Accordingly, the seal of the sliding carriage 20 is a clean seal because it slides on a clean protected surface of the pin 11. In consequence, the number of mating and demating cycles that can be performed by the subsea connector 100 can be increased significantly, in particular as the connector part 101 does not comprise any seal that slides over a surface that is exposed to seawater and on which marine growth may occur.

The diaphragm 30 is provided with a shape that minimizes volume changes of the enclosed volume 40 when the sliding carriage 20 is moved from the unmated position to the mated position. As can be seen from a comparison of FIGS. 1 and 2, the geometry changes significantly between the mated and the unmated position. In order to keep the volume 40 relatively constant, the diaphragm 30 employs a rolling mechanism. In the embodiment of FIG. 1, the sealing portion 31 is mounted to a sleeve 21 extending backwardly from the sliding carriage 20, i.e. extending in the direction of the support 10. The diaphragm 30 is mounted such that a fold 41 is formed. When the sliding carriage 20 moves towards the mated position, the fold 41 moves in forward direction along the sleeve 21, and thus essentially rolls up the diaphragm 30.

Figure 2:
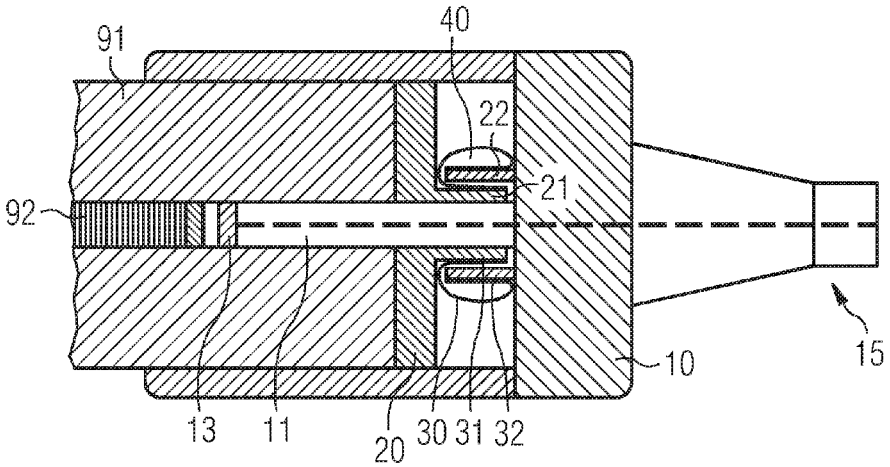
FIG. 2 is a schematic drawing showing a sectional side view of a connector part according to an embodiment of the invention in a mated position.

The second sealing portion 32 of the diaphragm 30 is in the embodiment of FIG. 1 sealed against a sleeve 22 extending forwardly from the support 10. Note that in other embodiments, sealing portion 32 may be sealed against another stationary surface, such as an outer surface in a rear portion of the pin 11, against the support 10 or to a different suitable element. In FIG. 1, the diaphragm 30 forms a second fold 42 in proximity to the sleeve 22. The fold 42 is such that when the sliding carriage 20 moves towards the mated position, the diaphragm 30 rolls along the surface of the sleeve 22. In the mated position, the diaphragm 30 accordingly has a shape as illustrated in FIG. 2. By way of such mechanism, the volume 40 enclosed by the diaphragm 30 can be kept relatively constant. Furthermore, the assembly as described with respect to FIGS. 1 and 2 does not require a sliding seal, but it uses a rolling method in which the diaphragm simply rolls over the surfaces provided by the sleeves 21 and 22. If these surfaces suffer from marine growth, e.g. due to contact with seawater, the diaphragm simply lays over the marine growth without increasing the danger of leakage. This way, the number of mating/demating cycles that can be performed before failure of the connector 100 can be increased.

As can be seen from the diagrams of FIG. 1 and FIG. 2, the sleeves 21 and 22 slide over each other, thereby increasing the distance which the sliding carriage 20 can travel. As can be seen from FIG. 2, more than 50% of the length of the pin 11 projects forwardly from the sliding carriage 20 when the sliding carriage 20 is in the mated position. For mating/demating the connector parts 101, 102, a certain stroke length is required to establish a firm connection, and thus a certain length of the pin needs to enter the plug 91. The additional length of the pin 11 that is required to accommodate the protection mechanism is less than half of the pin's length. In particular, the length of the pin 11 may be less than 1.5 times the stroke length, it may even be less than 1.4 times the stroke length. In an example configuration, the length of pin 11 may be about 1.3 times the stroke length. By enabling a reduced length of the pin 11, electrical and mechanical stresses in the pin can be reduced, thus improving the performance and reducing the danger of a failure caused by such stresses. In contrast, conventional protection mechanism which may employ a telescopic approach generally require a pin length of more than twice the stroke length.

As can be seen from FIG. 1, in the unmated position, the whole length, in particular the whole circumferential surface of pin 11 is protected from ambient medium. The degrading effect of ambient medium, such as seawater, can thus be prevented since the circumferential surface of pin 11 does not get into contact with such ambient medium, and the seal of sliding carriage 20 only slides on a clean surface.

Furthermore, due to the rolling and folding mechanism provided by diaphragm 13, the diaphragm keeps volume changes low, so that no additional external volume compensation mechanism is required. Furthermore, stretching of the diaphragm due to volume changes is reduced.

Figure 3A:
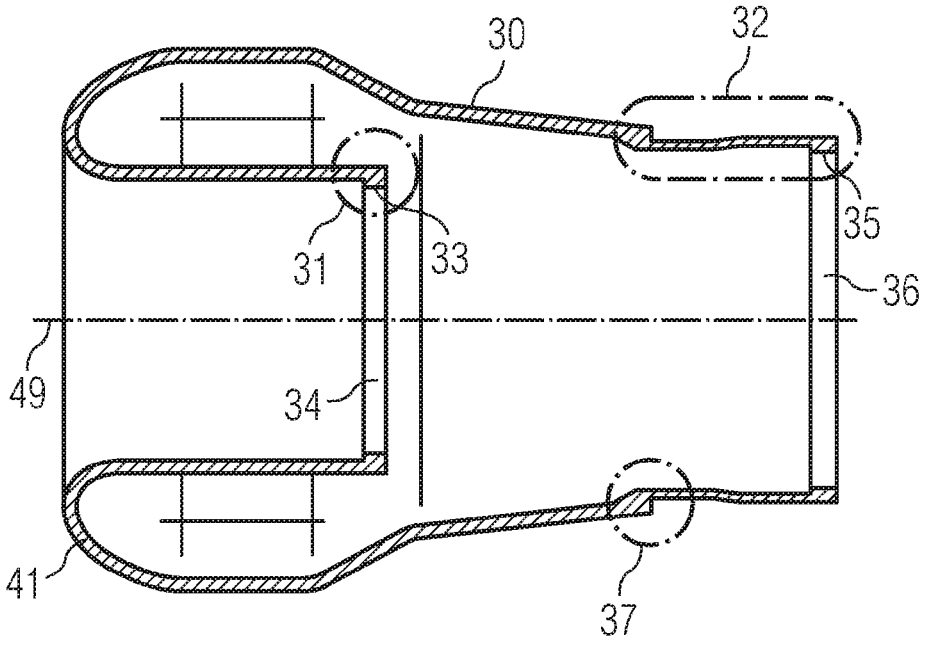
FIGS. 3A and 3B are schematic diagrams showing a diaphragm in accordance with an embodiment of the invention in a sectional side view and in a perspective view.

FIG. 3 schematically shows a diaphragm which may be used with embodiments of the invention, in particular with the embodiments of FIGS. 1, 2, 6 and 7. The diaphragm is molded in a shape in which it has a first opening 34 at a first end 33 of the diaphragm and a second opening 36 at a second end 35 of the diaphragm. The first sealing portion 33 is located in proximity to the first end 33. The second sealing portion 32 is located in proximity to the second end 35 of the diaphragm. Furthermore, the diaphragm is provided with a fold 41, which, when mounted, rolls along the sleeve 21. The diaphragm further comprises a latching portion 37, which is used for holding the diaphragm in a folded position which will be explained in more detail hereinafter with respect to FIGS. 4 and 5.

Figure 3B:
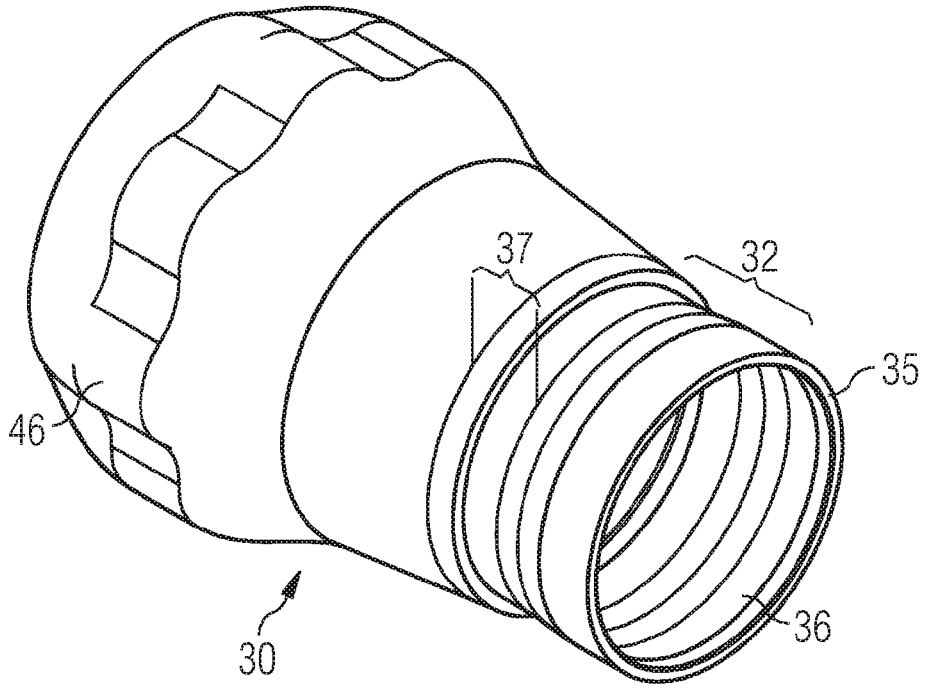

The perspective view of FIG. 3B illustrates that the main body of the diaphragm may be provided with corrugations 46. These corrugations extend substantially parallel to the axial direction of the diaphragm. The axial direction of the diaphragm is in FIG. 3A indicated with the reference numeral 49. By way of these corrugations 46, the volume enclosed by the diaphragm 30 may furthermore be changed without significantly stretching the material of the diaphragm 30. When seen as a cross section in a plane perpendicular to the axial direction 49, the circumferential profile of the diaphragm 30 has a wavy shape, with crests and troughs. For extending the volume enclosed by the diaphragm 30, the troughs can bulge outwards, whereas for reducing the enclosed volume, the crests can bulge inwards. Besides the above described mechanism, such shape of the diaphragm ensures that even if volume changes occur, they do not lead to a significant stretching of the diaphragm's material, thus increasing the lifetime of the diaphragm.

Figure 4A:
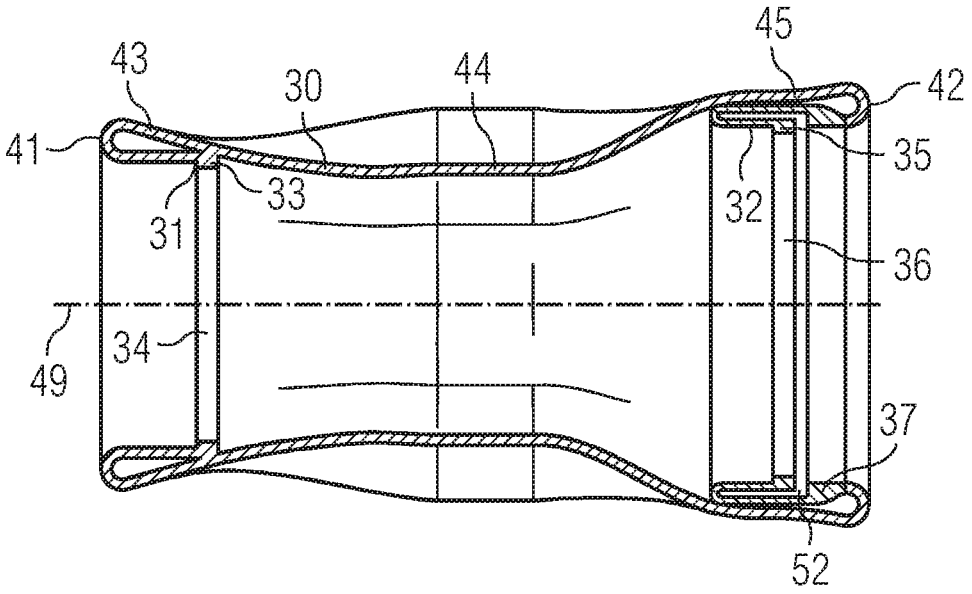
FIGS. 4A and 4B are schematic drawings showing a sectional side view and a perspective view of a diaphragm according to an embodiment of the invention when mounted in a connector part in an unmated position.

In FIG. 4A, a sectional side view of the diaphragm is shown when mounted to the connector part 101 and when the sliding carriage 20 is in the unmated position. The sealing portion 31 of the diaphragm is sealed against the sleeve 21. As can be seen, the fold 41 is in the unmated position located in proximity to the first end 35 of the diaphragm 30. The main body of the diaphragm 30 has a forward portion 43, a middle portion 44 and a rearward portion 45 which extend along the axial length of the pin in the unmated position as illustrated in FIG. 4*a*. A second fold 42 is provided for enabling the rolling of the diaphragm along the sleeve 22. The second sealing portion 32 of the diaphragm 30 is fixed on the sleeve 22 via a locking member 52, which may for example be a locking ring or retaining ring. As can be seen in FIG. 4A, the second end 35 points towards the support 10. The diaphragm 30 is folded back over the locking member 52, and the latching portion 37 is in a latching engagement with the locking member 52. The latching portion 37 also provides a seal against the sleeve 22, thereby sealing the locking member 52 against the ambient medium.

Figure 8:
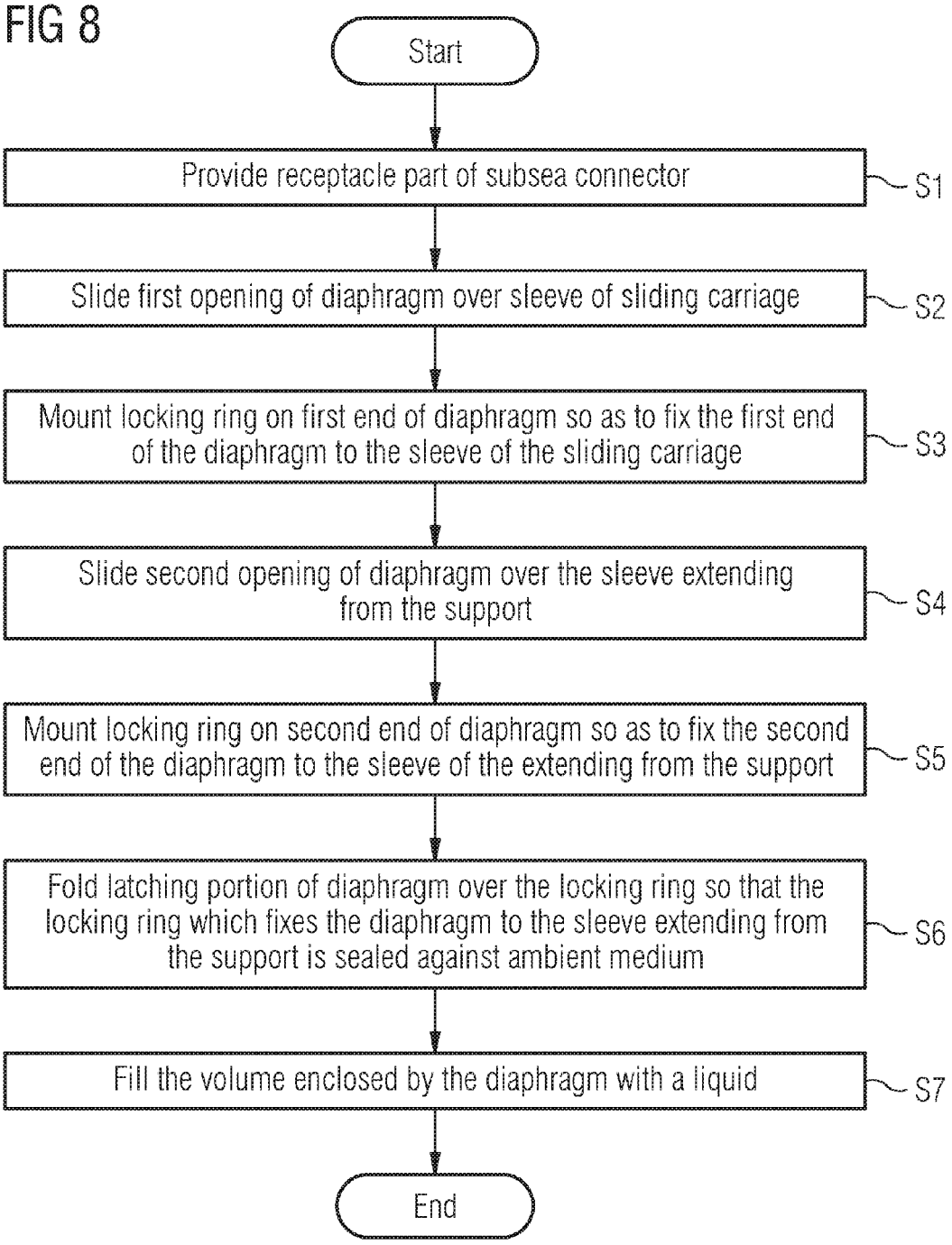
FIG. 8 is a flow diagram illustrating a method according to an embodiment of the invention.

Such configuration enables a relatively simple mounting of the diaphragm 30 to the connector part 101. A method of assembling the connector part 101 is illustrated in FIG. 8. In a first step S1, the connector part, in particular the receptacle part of the subsea connector is provided. The first opening 34 of the diaphragm 30 is slid over the sleeve 21 of the sliding carriage 20 in step S2. A locking member, such as a locking ring or a retaining ring 52 (not illustrated in FIG. 4A) is mounted over the diaphragm at its first end 35, so as to fix the diaphragm to the sleeve and provide a secure seal. Since the end 35 of the diaphragm 30 is folded inwards, the locking member 51 is located within the volume 40 enclosed by the diaphragm 30, and it is thus protected from ambient medium. A second locking member 52 is then provided on the sleeve 22 and the second opening 36 of the diaphragm is slid over the second sleeve 22 (step S4). The second locking member 52, in particular a locking ring or retaining ring is then mounted on the second end 53 of the diaphragm, so as to fix the diaphragm to the second sleeve 22 (step S5). Since the end 35 is pointing towards the support, the second locking member 52 is located outside the enclosed volume 40, and may thus be exposed to ambient medium. To prevent such exposure, the diaphragm is folded back over the locking member 52, thereby protecting the locking member 52 and providing the second fold 42 (step S6). The volume enclosed by the diaphragm 30 is now fully sealed against the ambient medium, it can be filled with a filling medium, such as a liquid, in particular dielectric liquid (step S7). Accordingly, a relatively simple and effective way of mounting the diaphragm 30 is provided, with both locking members 51, 52 which hold the diaphragm in place being protected from ambient medium. The latching portion 37 prevents the diaphragm 30 from unfolding when the sliding carriage 20 is in the unmated position, as illustrated in FIG. 4A. As can be seen from FIGS. 3A and 4A, the latching portion of the diaphragm may for example comprise a step formed within the outer surface of the diaphragm.

Figure 4B:
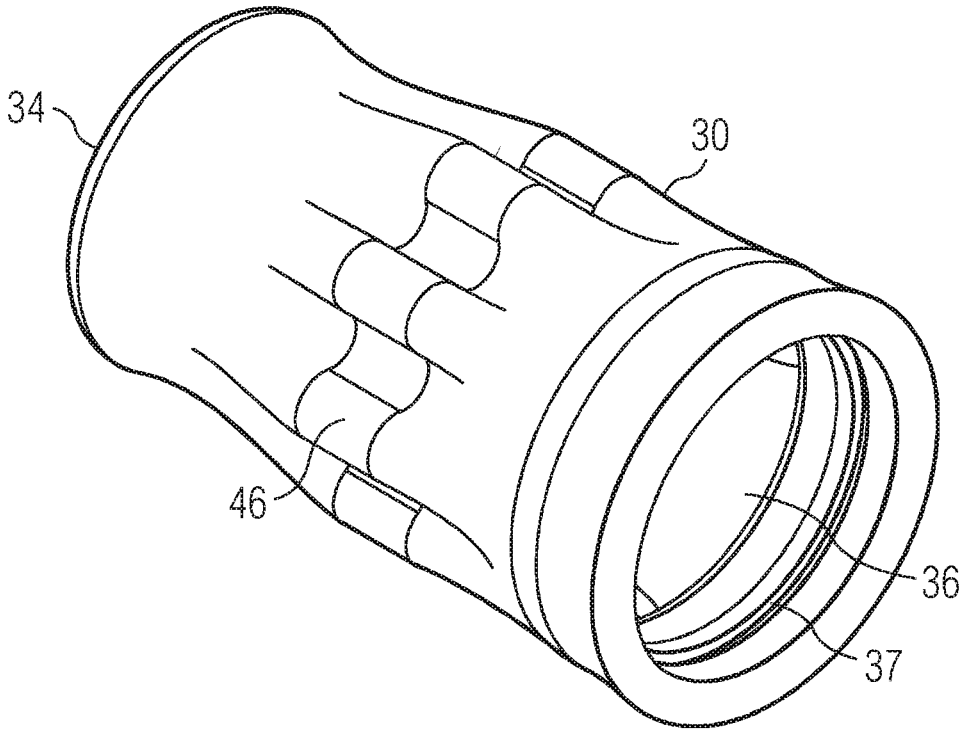

FIG. 4B shows a perspective view of the diaphragm of FIG. 4A. FIG. 4B illustrates that in the unmated position, the corrugations 46 may be in a collapsed state, thereby reducing the volume enclosed by the diaphragm 30.

Figure 5A:
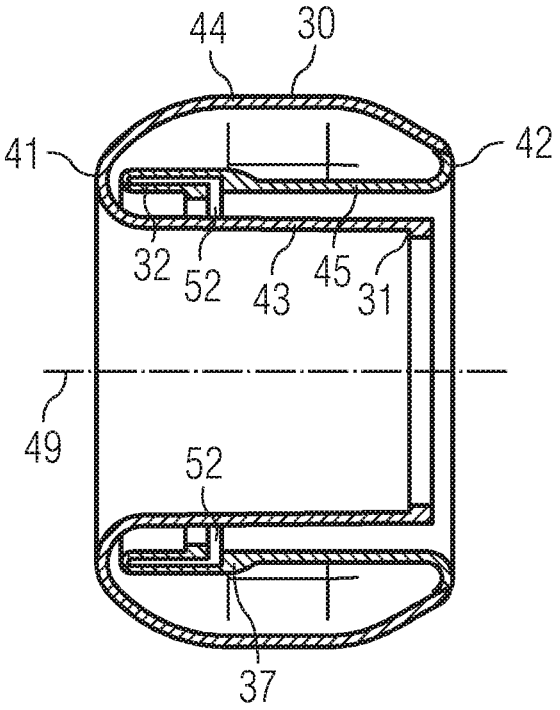
FIGS. 5A and 5B are schematic drawings showing a sectional side view and a perspective view of a diaphragm according to an embodiment of the invention when mounted in a connector part in a mated position.
Figure 5B:
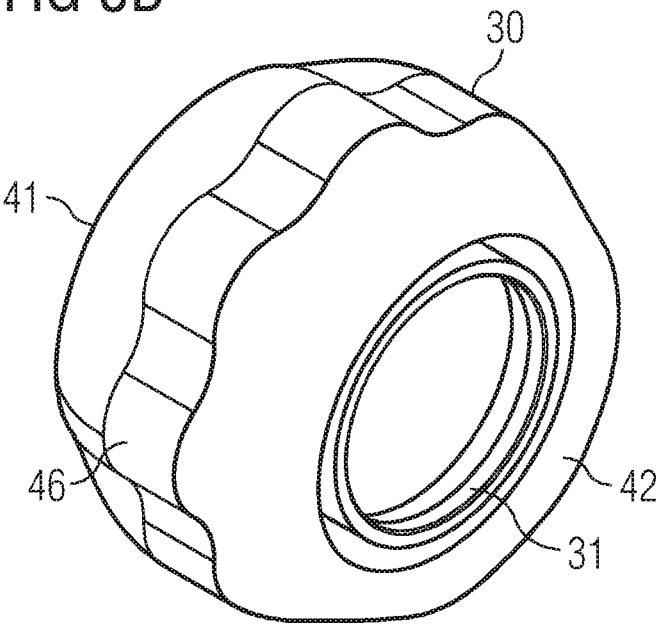

FIGS. 5A and 5B illustrate the diaphragm 30 of FIGS. 3 and 4 when mounted to the connector part 101 and when the sliding carriage 20 is in the mated position. As can be seen, the folds 41 and 42 are now unrolled, so that the diaphragm 30 is in a folded stage in which portions of the diaphragm overlap. In particular, the first sealing portion is now located backwardly of the second sealing portion 32, i.e. first sealing portion 31 is now located closer to the support 10. Three axial portions of the diaphragm overlap in radial direction. The forward portion 43, the middle portion 44 and the rearward portion 45 now overlap, meaning if moving from the axis 49 outwardly in radial direction, the three portions of the diaphragm 30 are crossed. FIG. 5A further illustrates that the fold 41 is now located further away from the sealing portion 31, and the fold 42 is located further away from the sealing portion 32, since the fold has rolled along the surface of the respective sleeve 21, 22.

The perspective view of FIG. 5B shows that in the mated position, the corrugations 46 of the diaphragm 30 may be in an expanded state, thereby accommodating for the geometry change when sliding the first and second sleeves 21, 22 over each other. The expanded state of the corrugations 46 ensures that the volume enclosed by the diaphragm 30 remains substantially constant without significantly stretching the material of diaphragm 30.

When filling the diaphragm 30 with a liquid, the volume 40 may be slightly overfilled to generate a certain amount of internal pressure, resulting in a certain stretch of the diaphragm material. Such slight overpressure will ensure that in case of a minor leakage, ambient medium will not enter the enclosed volume, but the liquid filling the enclosed volume will rather cause some of the filling liquid to leak out.

Figure 6A:
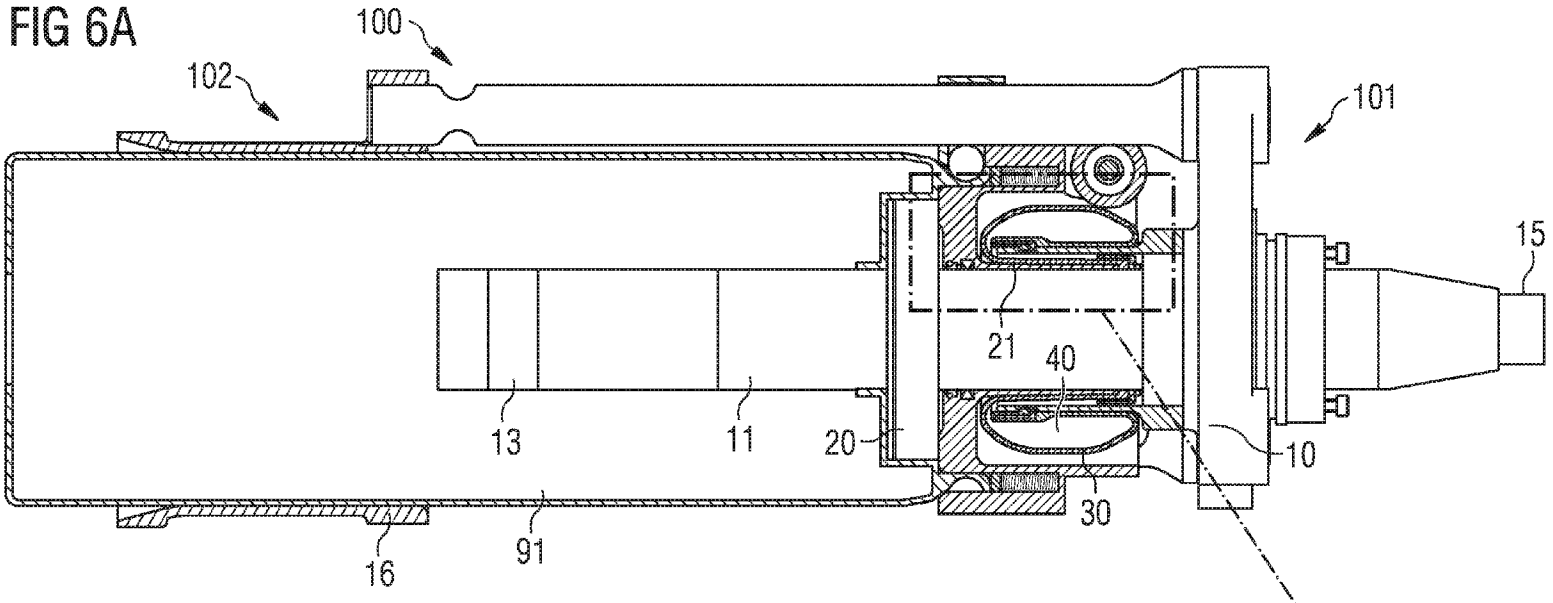
FIGS. 6A and 6B are schematic diagrams showing a sectional side view of a connector part in the mated position according to an embodiment of the invention.
Figure 6B:
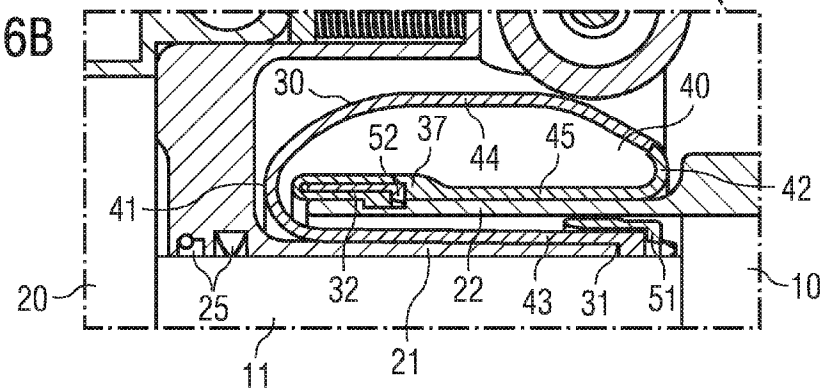

FIG. 6A shows a sectional view of a further embodiment of a subsea connector 100 including a connector part 101 according to the invention. FIG. 6B shows an enlarged view of a section of FIG. 6A. In FIG. 6A, the first connector part 101 is shown in a state in which it is mated with the second connector part 102. The sliding carriage is accordingly in the mated position. The diaphragm 30 is in the folded position, as illustrated in FIG. 5A. Note that the embodiment of FIG. 6 is a particular implementation of the embodiments of FIGS. 1 and 2, and may make use of the diaphragm as shown in FIGS. 3, 4 and 5, so that the explanations given further above are equally applicable to the embodiment of FIG. 6.

FIG. 6B illustrates that in the mated position of the sliding carriage 20, the reward portion 45 of the diaphragm 30 extends along the second sleeve 22, and the second fold 42 is located in proximity to the support 10. The middle portion 44 of the diaphragm 30 extends from the second fold 42 to the first fold 41. The first fold 41 is located in proximity to the sliding carriage 20. The forward portion 43 of the diaphragm 30 now extends along the first sleeve 21. The locking member 51 fixes the diaphragm 30 at the first sealing portion 31 to the sleeve 21. As explained further above, the second locking member 52 fixes the diaphragm at the second sealing portion 32 to the sleeve 22. Again, the latching portion 37, which comprises a thicker portion of the diaphragm material and a step in the outer surface of the diaphragm, is folded over the second locking member 52 and latched so as to retain its position even when the diaphragm 30 is unrolled.

FIG. 6B also illustrates the sliding seal 25 which provides sealing between the sliding carriage 20 and the circumferential surface of pin 11. Note that as illustrated in FIG. 6A, the sliding carriage 20 may have a more complex configuration as suggested by the simplified schematic drawings of FIGS. 1 and 2.

Note that in FIG. 6A, the plug body 91 is for the purpose of a comprehensive presentation only shown as an envelope. Reference numeral 16 indicates the receptacle capture cone into which the plug body 91 enters during mating and which provides guidance to the plug body.

Figure 7A:
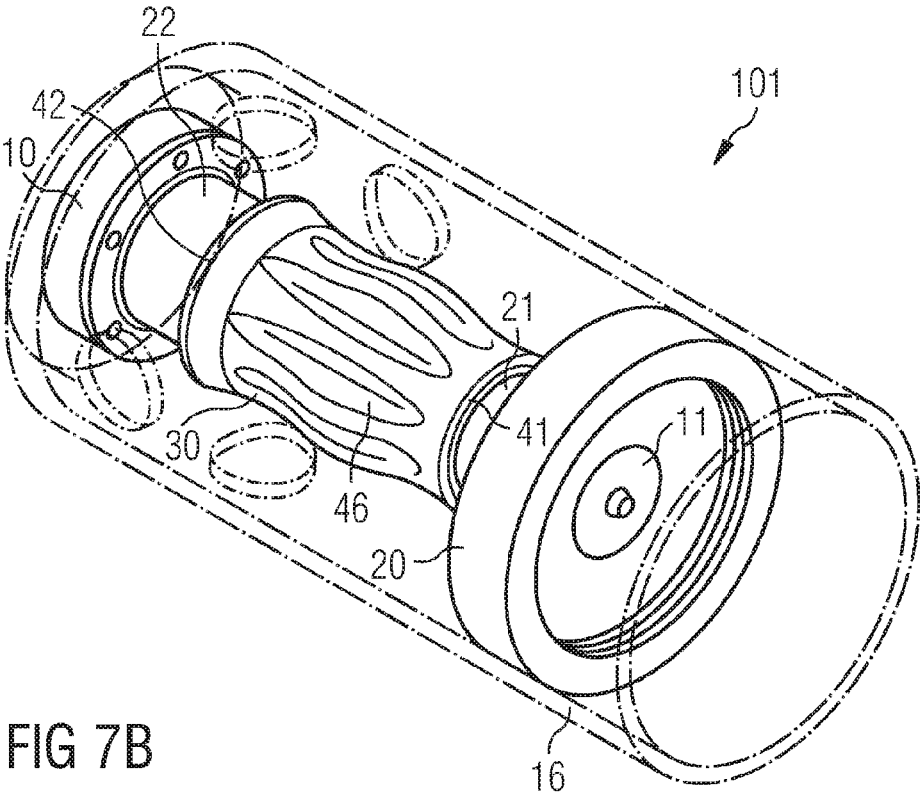
FIGS. 7A and 7B are schematic diagrams showing a perspective view of a connector part according to an embodiment of the invention in the unmated position and in the mated position.
Figure 7B:
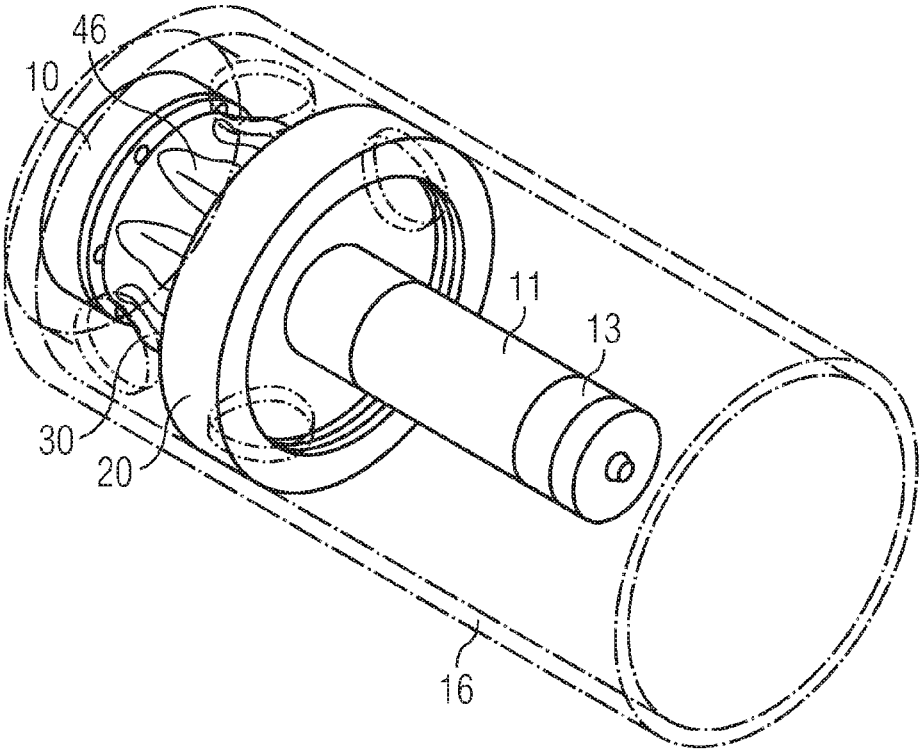

FIGS. 7A and 7B are schematic drawings showing partially transparent perspective views of a plug part 101 in an unmated position (FIG. 7A) and in a mated position (FIG. 7B). As can be seen in FIG. 7A, the sliding carriage 20 may comprise a disk having a front surface which in the unmated position of the sliding carriage is essentially level with the front surface of the pin 11. The diaphragm 30 is at its first end mounted to the sleeve 21, and at its second end mounted to the second sleeve 22 which extends forwardly from the support 10. The diaphragm 30 is in the unfolded state, with folds 41 and 42 being spaced away from the sliding carriage 20 and the support 10, respectively. The corrugations 46 in the diaphragm body 30 are in a collapsed state. Holes in the receptacle cone 16 enable the passage of ambient medium, such as seawater, out of the cone when the sliding carriage 20 is moved into a mated position.

The mated position is illustrated in FIG. 7B. For the purpose of presentation, the second connector part 102 is not shown in FIG. 7B. As can be seen, the pin 11 projects forwardly from the sliding carriage 20, which is in the mated position. Accordingly, more than half of the length of the pin 11 is exposed, as well as the connection portion 13 of the pin. The diaphragm 30 is now in the folded state, so that portions of the diaphragm overlap. The sleeve 21 is slid into the annular space formed between the sleeve 22 and the pin 11. Folds 41 and 42 have now rolled towards the sliding carriage 20 and the support 10, respectively, thus causing the overlap and significantly reducing the axial extension of diaphragm 30. A compact configuration in the mated position can thus be achieved.

The corrugations in the main body of the diaphragm 30 are now expanded to form an almost circular shape, thereby increasing the volume of the central section of the diaphragm. The total volume enclosed by the diaphragm 30 can thus be kept relatively constant even in the folded position of the diaphragm.

As outlined above, the use of the diaphragm 30 for protecting the pin 11 against ambient medium, in particular seawater, has several advantages. The pin can be protected over its whole axial length, preventing the exposure to seawater and marine growth. The rolling diaphragm prevents the use of a seal which is sliding on a "dirty" surface on which marine growth may form. Furthermore, the length of the pin can be kept relatively short, in other words a relatively large fraction of the pin 11 is available for mating when the sliding carriage 20 is in the mated position. The folding method and the corrugated surface of the diaphragm allow the volume enclosed by the diaphragm to stay relatively constant when moving from the unmated into the mated position. This may reduce the packaging length, may alleviate the need for two sliding seals and for external volume compensation mechanisms. The corrugation provided in the body of the diaphragm may furthermore accommodate volume changes due to temperature and/or pressure.

While specific embodiments are disclosed herein, various changes and modifications can be made without departing from the scope of the invention. The present embodiments are to be considered in all respects as illustrative and non-restrictive, and all changes coming within the meaning and equivalency range of the appended claims are intended to be embraced therein.

The invention claimed is:

1. A connector part for use underwater or in a wet or severe environment, comprising:

a pin projecting axially forwardly from a support;

a sliding carriage, in sealing engagement with the pin, the sliding carriage being movable between an unmated position and a mated position along the pin and the sliding carriage being in sealing engagement with the pin both in the unmated and in the mated position; and a diaphragm, enclosing a volume around the pin, including a first sealing portion mounted to and sealed to the sliding carriage to be movable together with the sliding carriage, and including a second sealing portion sealed to a portion of the connector part which is stationary relative to the pin and the support and arranged, in the unmated position, backwardly of the sliding carriage.

2. The connector part of claim 1, wherein the diaphragm provides a liquid tight barrier around the pin such that, in the unmated position of the sliding carriage, the circumferential face of the pin is protected from ambient medium at least between the sliding carriage and the portion of the connector part to which the second sealing portion of the diaphragm is sealed.

3. The connector part of claim 2, wherein the pin includes an axial length, wherein the sealing portion of the connector part, stationary relative to the pin, is located at an axial position within the rear third of the pin's axial length.

4. The connector part of claim 3, wherein the pin includes an axial length, wherein the sealing portion of the connector part, stationary relative to the pin, is located at an axial position within the rear quarter of the pin's axial length.

5. Diaphragm for use with the connector part of claim 2, comprising:

a first end, surrounding a first opening, the first end providing the first sealing portion of the diaphragm, the diaphragm being moulded such that the first end is folded inwards so that the first end is located within a volume surrounded by the diaphragm;

a second end, surrounding a second opening, the second sealing portion being located at or adjacent to the second end; and a diaphragm body, extending between the first end and the second end.

6. A subsea connector comprising:

the connector part of claim 2; and a second connector part, the second connector part being wet-mateable with the first connector part, the first and second connector parts being formed such that during mating, the sliding carriage is moved from the unmated position to the mated position.

7. The connector part of claim 1, wherein the pin includes an axial length, wherein the sealing portion of the connector part, stationary relative to the pin, is located at an axial position within the rear third of the pin's axial length.

8. The connector part of claim 7, wherein the pin includes an axial length, wherein the sealing portion of the connector part, stationary relative to the pin, is located at an axial position within the rear quarter of the pin's axial length.

9. The connector part of claim 1, wherein the sliding carriage comprises a first sleeve extending backwardly from the sliding carriage with the first sealing portion being arranged at a backward end of the first sleeve, wherein the connector part comprises a second sleeve extending forwardly from the support, the second sealing portion being arranged at an forward end of the second sleeve, and wherein the first and second sleeves at least partially slide over each other when the sliding carriage is moved into the mated position.

10. The connector part of claim 1, wherein the pin projects axially forwardly from the support by a predefined axial length, and wherein the diaphragm is configured so as to enable a movement of the sliding carriage to a mated position in which more than 50% of the axial length of the pin are exposed.

11. The connector part of claim 10, wherein the pin projects axially forwardly from the support by a predefined axial length, and wherein the diaphragm is configured so as to enable a movement of the sliding carriage to a mated position in which more than 60% of the axial length of the pin are exposed.

12. The connector part of claim 11, wherein the pin projects axially forwardly from the support by a predefined axial length, and wherein the diaphragm is configured so as to enable a movement of the sliding carriage to a mated position in which more than 70% of the axial length of the pin are exposed.

13. The connector part of claim 1, wherein in the mated position of the sliding carriage, the diaphragm forms at least one fold so that at least a first axial portion and a second axial portion of the diaphragm overlap.

14. The connector part of claim 1, wherein the sliding carriage and the diaphragm are configured such that, in the unmated position of the sliding carriage, the first sealing portion is located forwardly of the second sealing portion of the diaphragm, and that, in the mated position of the sliding carriage, the first sealing portion is located backwardly of the second sealing portion of the diaphragm.

15. The connector part of claim 1, further comprising a sleeve extending axially forwardly from the support, wherein the second sealing portion of the diaphragm is in sealing engagement with the sleeve, the sleeve providing the portion of the connector part which is stationary relative to the pin.

16. The connector part of claim 15, wherein the sleeve surrounds a portion of the pin so as to form an annular space that is sized such that the first sealing portion of the diaphragm is movable into the annular space.

17. The connector part of claim 1, wherein the diaphragm includes a portion that extends from the second sealing portion towards the support, a fold adjacent to the portion and a further portion adjacent to the fold which extends away from the support, such that the fold is moving towards the support when the sliding carriage is moved from the unmated position to the mated position.

18. The connector part of claim 1, wherein the diaphragm comprises an end portion at an end of the diaphragm surrounding an opening of the diaphragm, the second sealing portion being comprised in the end portion, wherein the end portion further comprises:

a fixation portion, at which the diaphragm is fixed to the portion of the connector part which is stationary relative to the pin by way of a locking member such that the end of the diaphragm points towards the support, and a latching portion, wherein the latching portion is folded back over the fixation portion and the locking member, the latching portion of the diaphragm being latched so as to retain the folded back position of the diaphragm.

19. The connector part of claim 18, wherein the latching portion is folded back over the fixation portion and the locking member, the latching portion of the diaphragm being latched so as to retain the folded back position of the diaphragm, the latching portion being latched to the locking member.

20. The connector part of claim 1, wherein the diaphragm includes a cross section with a non-circular profile, the non-circular profile allowing the volume enclosed by the diaphragm to change without substantially changing the length of the profile.

21. The connector part of claim 20, wherein the diaphragm includes a cross section with a corrugated profile.

22. The connector part of claim 1, wherein the pin and the sliding carriage are configured such that, in the unmated position of the sliding carriage, a front portion of the pin is exposed to the surrounding environment.

23. The connector part of claim 1, wherein forwardly of the support, the pin includes a cylindrical portion which ends in a end face that faces away from the support, wherein the sliding carriage is disc-shaped is in its unmated position arranged around the cylindrical portion of the pin, the sliding carriage being sealed against an outer cylindrical face of the cylindrical portion, wherein at least the end face of the pin is exposed to the surrounding environment in the unmated position of the sliding carriage.

24. Diaphragm for use with the connector part of claim 1, comprising: a first end, surrounding a first opening, the first end providing the first sealing portion of the diaphragm, the diaphragm being moulded such that the first end is folded inwards so that the first end is located within a volume surrounded by the diaphragm;

a second end, surrounding a second opening, the second sealing portion being located at or adjacent to the second end; and a diaphragm body, extending between the first end and the second end.

25. The diaphragm of claim 24, further comprising a latching portion, adjacent to or forming part of the second sealing portion, wherein the latching portion includes a step in the outer diaphragm surface for engagement with a complementary latching portion of the connector part.

26. A subsea connector comprising:

the connector part of claim 1; and a second connector part, the second connector part being wet-mateable with the first connector part, the first and second connector parts being formed such that during mating, the sliding carriage is moved from the unmated position to the mated position.

27. A method of assembling a connector part for use underwater or in a wet or severe environment, comprising:

providing a connector part including a pin and a sliding carriage, the sliding carriage being movable along the pin between a unmated position and a mated position and being in sealing engagement with the pin both in the unmated and in the mated position;

providing a hollow diaphragm including a first opening and a second opening;

mounting the diaphragm at the first opening to the sliding carriage and sealing the first opening of the diaphragm at a first sealing portion against the sliding carriage, so that the first sealing portion is movable together with the sliding carriage; and sealing the second opening of the diaphragm at a second sealing portion against a portion of the connector part which is stationary relative to the pin and the support, the sealing being such that the diaphragm encloses a volume around the pin.

* * * * *